US006748770B2

(12) United States Patent
Okamoto

(10) Patent No.: US 6,748,770 B2
(45) Date of Patent: Jun. 15, 2004

(54) METHOD OF LINKING TUBULAR KNITTED FABRICS TOGETHER AND KNITTED FABRIC THEREFOR

(75) Inventor: Kazuyoshi Okamoto, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 10/470,167

(22) PCT Filed: Jan. 25, 2002

(86) PCT No.: PCT/JP02/00577

§ 371 (c)(1),
(2), (4) Date: Jul. 24, 2003

(87) PCT Pub. No.: WO02/063085

PCT Pub. Date: Aug. 15, 2002

(65) Prior Publication Data

US 2004/0065123 A1 Apr. 8, 2004

(30) Foreign Application Priority Data

Feb. 2, 2001 (JP) ..... 2001-026805

(51) Int. Cl.[7] ..... D04B 7/10
(52) U.S. Cl. ..... 66/64; 66/176
(58) Field of Search ..... 66/69, 176, 64, 66/60 R, 171, 189, 175, 70, 170, 75.1, 172 R

(56) References Cited

U.S. PATENT DOCUMENTS 5,203,185 A * 4/1993 Okuno ..... 66/171
5,377,507 A * 1/1995 Shima ..... 66/69
5,826,445 A * 10/1998 Okamoto ..... 66/70
5,987,930 A 11/1999 Nakai
6,286,340 B1 * 9/2001 Yui ..... 66/70
6,581,417 B2 * 6/2003 Yui ..... 66/176
6,655,175 B1 * 12/2003 Okamoto ..... 66/69

FOREIGN PATENT DOCUMENTS

JP 9-310254 A 12/1997
JP 11-222750 A 8/1999
JP 3121278 B2 12/2000

* cited by examiner

*Primary Examiner*—Danny Worrell
(74) *Attorney, Agent, or Firm*—Rothwell, Figg, Ernst & Manbeck, P.C.

(57) ABSTRACT

A knitting method of joining together adjacent fabrics (3, 5), which are arranged side by side and knitted in a tubular form, at ends thereof on the sides adjacent to each other by using a flat knitting machine so that the joining portion of knitwear, such as a side part of sweater or at a crotch of pants, is prevented from being holed and is also increased in pull strength. The knitting progresses from one of the tubular knitted fabrics (3) to the other tubular knitted fabric (5) to join together the tubular fabrics, during which a yarn is fed to needles holding loops formed one stitch backward with respect to a join processing direction to provide a tubular knitting for the needles, followed by shifting the yarn to needles holding loops formed two stitches forward with respect to the join processing direction, to provide the same tubular knitting as above for the needles, the knitting steps being repeatedly performed.

8 Claims, 6 Drawing Sheets

METHOD OF LINKING TUBULAR KNITTED FABRICS TOGETHER AND KNITTED FABRIC THEREFOR

TECHNICAL FIELD

The present invention relates to improvement of a method of joining at least two adjacent tubular knitted fabrics to each other at ends thereof on the side adjacent to each other, such as, for example, at a side part of a sweater at which the sleeves and body are jointed to each other and at a crotch of tights at which the legs are joined to each other.

BACKGROUND ART

For example, when knitwear, such as a sweater, is knitted by using a flat knitting machine, its body and right and left sleeves commences knitting from the hem toward the shoulder with needles in different regions on the flat knitting machine. The body and the right and left sleeves are each knitted in the form of a tubular fabric in which their front fabrics knitted with needles of a front needle bed and their back fabrics knitted with needles of a back needle bed are joined to each other at ends thereof on the side parts adjacent to each other. After the body and both sleeves are joined to each other at their side parts, they are knitted into a large tubular fabric from the side parts toward shoulder by feeding a yarn to both of the body and the sleeves. This knitting method can produce knitwear that can eliminate or simplify the sewing process after knitting. As is the case with the side part of the sweater, the crotch of tights is also formed by joining both knitted fabrics to each other. In the tights, right and left legs are each knitted into a tubular form, starting from toes toward waist, and then are joined to each other at the boundary between the legs and the waist and, thereafter, are knitted into a large tubular fabric in the waist.

According to a generally known method of joining together two adjacent knitted tubular fabrics to form the side part or the crotch, after loops of one tubular knitted fabric are transferred to the other adjacent tubular knitted fabric to overlap loops of both knitted fabrics with each other at ends thereof on the side adjacent to each other, so as to form double loops, loops of the next course are formed in the double loops in subsequent knitting to join together the two adjacent tubular knitted fabrics.

However, since the joining portion is formed by merely overlapping the loops at the ends of the adjacent knitted fabrics with each other, when the knitted fabric is pulled in wearing, the pulling force is concentrated at the overlapped loops in the joining portion and, as a result, the knitted fabric are torn easily at the joining portion. In addition, since the joining portion is formed by merely forming loops of the next course sequent to the double loops, the joining portion is holed so that the joining portion may spoil the design of the knitwear.

In general, in order to prevent the joining portion from being holed, the joining portion is knitted in rib knitting with zigzag yarn feed to the needles of the front and back needle beds holding some loops of the adjacent knitted fabrics at ends thereof on the side of the boundary between the both knitted fabrics. However, this knitting is not so effective for preventing the knitted fabric from being tone at the joining portion, thus still presenting the functional problem, such as pull strength, for the side parts of the sweater and the crotch of the tights.

It is an object of the present invention to provide a knitting method of joining together adjacent tubular knitted fabrics at ends thereof on the sides adjacent to each other so that the joining portion of knitwear, such as the side part of sweater or at the crotch of pants, can be prevented from being holed and also can provide increased pull strength, and to provide a knitted fabric knitted in this knitting method.

Disclosure of the Invention

To accomplish the object mentioned above, the present invention provides a method of joining together at least two tubular knitted fabrics by using a flat knitting machine comprising at least a pair of first and second needle beds, either or both of which is capable of being racked in a horizontal direction, wherein after front and back knitted fabric parts of the tubular knitted fabrics are joined to each other at widthwise ends thereof on the side adjacent to each other to form the at least two tubular knitted fabrics with needles in different regions on the flat knitting machine, the tubular knitted fabrics thus formed are joined to each other at ends thereof on the side adjacent to each other, to form a joining portion, such as a side part or a crotch of knitwear, and wherein the joining process commences from one of the tubular knitted fabrics toward the other tubular fabric in the state in which one of the front knitted fabric part and the back knitted fabric part of the at least two tubular knitted fabrics is held on the first needle bed and the other of the front knitted fabric part and the back knitted fabric part of the at least two tubular knitted fabrics is held on the second needle bed, to join together the both tubular knitted fabrics, the method comprising the following steps:

a) providing a tubular knitting, starting a joining process from a needle (h) holding a loop in a wale of one of the tubular knitted fabrics at an end thereof, in which a yarn is fed to the needle (h) of one needle bed holding the loop in the wale of the one tubular knitted fabric at an end thereof in a direction opposite to a join processing direction, to form a knitted loop thereon, first, and, then, the yarn is fed to a needle (h) of the other needle bed in the join processing direction, to form a knitted loop thereon, b) providing the same tubular knitting as in the step a) for needles (g) holding loops formed one stitch backward of the needles (h) used in the step a) with respect to the join processing direction, c) shifting the yarn to the needles (i) holding loops in a wale of the other tubular knitted fabric at an end thereof on the side adjacent to the one tubular knitted fabric formed two stitches forward of the needles (g) used in the step b) with respect to the join processing direction, to provide the same tubular knitting as in the step above for the needles (i), d) feeding the yarn to the needles (h) holding the loops of the other tubular knitted fabric formed one stitch backward of the needles (i) used in the step c) with respect to the join processing direction, to provide the same tubular knitting as in the step above for the needles (h), e) shifting the yarn to the needles (j) holding loops formed two stitches forward of the needles (h) used in the step d) with respect to the join processing direction, to provide the same tubular knitting as in the step above for the needles (j), and f) feeding the yarn to the needles (i) holding the loops formed one stitch backward of the needles (j) used in the step e) with respect to the join processing direction, to provide the same tubular knitting as in the step above for the needles (i).

Preferably, the joining portion is provided by using the yarn used in knitting the one tubular knitted fabric.

In the method mentioned above, an adequate number of empty needles may be inserted in between the adjacent tubular knitted fabrics and the steps of feeding the yarn to the needles holding loops formed one stitch backward and then to the needles holding loops formed two stitches forward with respect to the join processing direction may be repeatedly provided for the empty needles as well to form the knitted loops thereon, so as to form a gore in the joining portion.

The knitted loops in the gore are formed in the rib knitting.

The present invention provides a knitted fabric produced in the method mentioned above.

According to this, when at least two adjacent tubular knitted fabrics are joined together at ends thereof on the side adjacent to each other, to form a side part or a crotch of knitwear, the process to join together the adjacent knitted fabrics progresses from one of the tubular fabrics to the other tubular fabric. During this process, a yarn is fed to needles holding loops formed one stitch backward with respect to a join processing direction to provide a tubular knitting for the needles, followed by shifting the yarn to needles holding loops formed two stitches forward with respect to the join processing direction, to provide the same tubular knitting as above for the needles, the knitting steps being repeatedly performed. As a result of this, a cross-over yarn is extended straight between the front and back knitted loops of the one tubular knitted fabric formed at an end thereof on the side adjacent to the other tubular fabric joining portion in the tubular knitting. This cross-over yarn enables the knitted loops in the joining portion to be joined to each other closely so as to prevent the joining portion from being holed. Also, since the tubular knitting is repeatedly performed with the needles holding the loops formed one stitch backward and the needles holding the loops formed two stitches forward with respect to the join processing direction, a cross-over yarn is extended between the right and left knitted loops. As a result of this, even when the joining portion of the knitted fabric is pulled in wearing, since the cross-over yarn is drawn out from the knitted fabric, the knitted fabric can be prevented from being tone at the joining portion. Also, this cross-over yarn to be drawn out from the knitted fabric serves to provide stretch for the joining portion of the knitted fabric.

The joining process may be provided in the state in which an adequate number of empty needles are inserted in between the adjacent tubular fabrics. In this joining process, the step of feeding the yarn to empty needles holding the loops formed one stitch backward and then to the empty needles holding the loops formed two stitches forward of the needles with respect to the join processing direction is repeatedly taken to form knitted loops. As a result of this, a gore is formed in between the adjacent tubular knitted fabrics. The gore thus formed can allow the joining portions of adjacent knitted fabrics to be closely joined to each other and also be well stretched via the cross-over yarn extending front and back and the cross-over yarn extending right and left. By forming the gore in the rib knitting, the number of times the yarn feeder is reversed in the yarn feed direction can be reduced to provide an improved knitting efficiency.

BEST MODE FOR CARRYING OUT THE INVENTION

Figure 1:
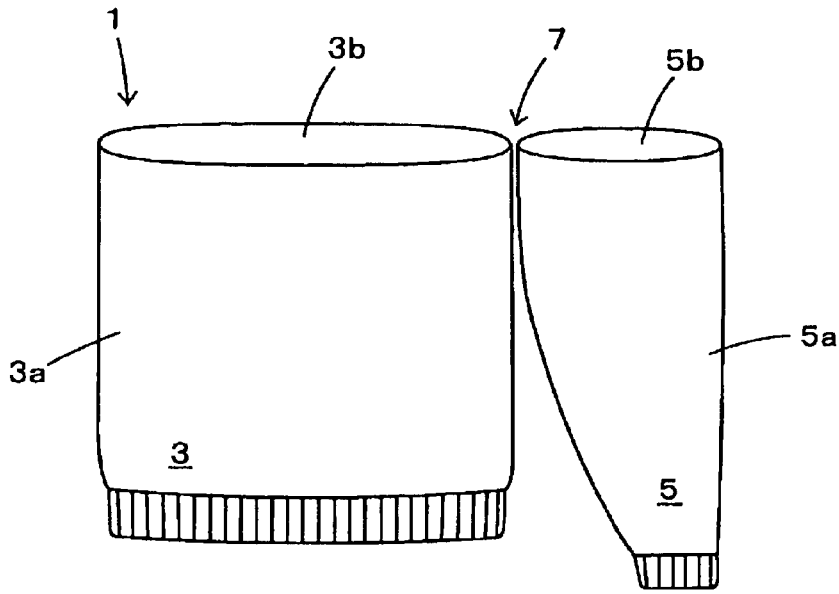
FIG. 1 shows sweater immediately before joining together the body and the left sleeve at a side part thereof.
Figure 2:
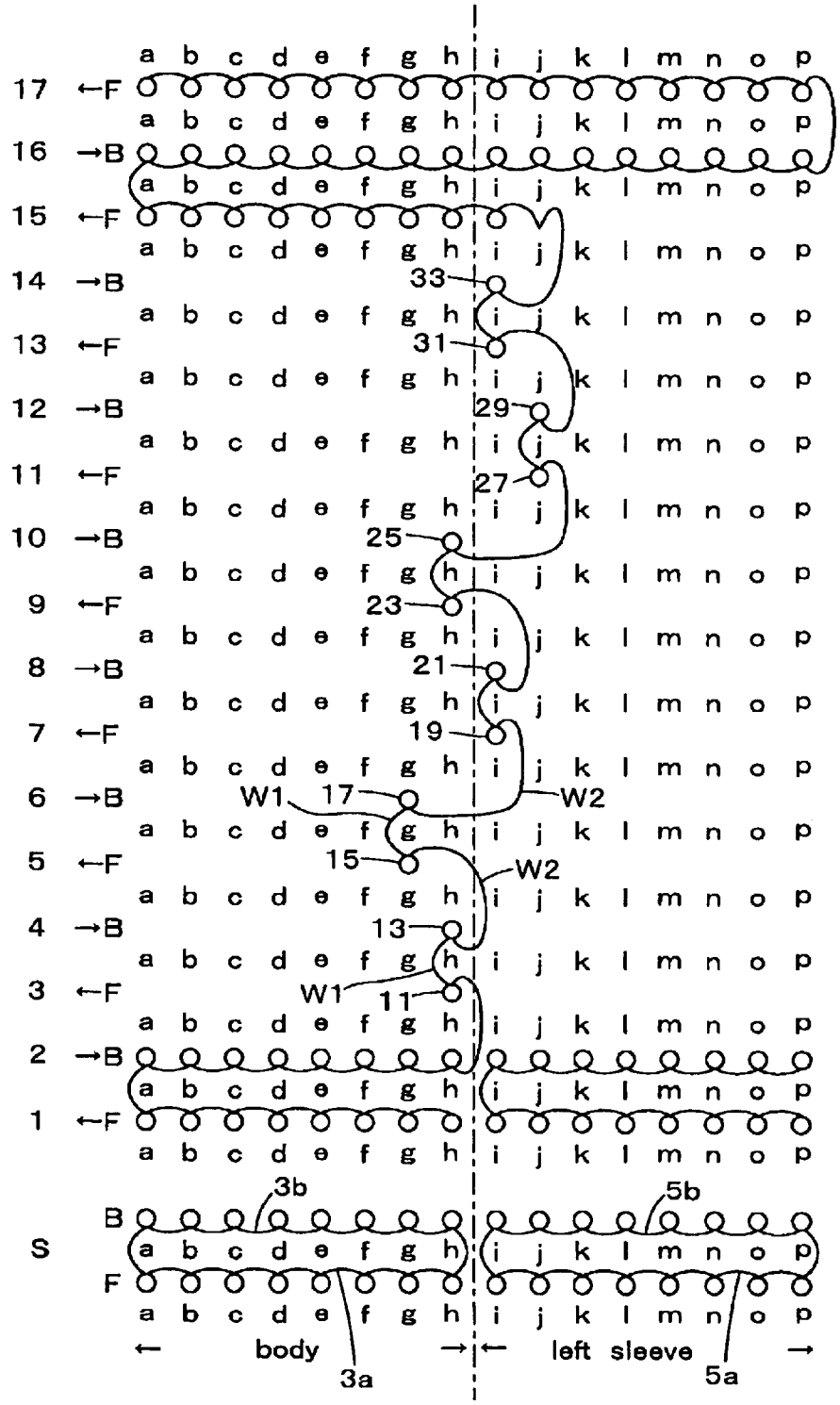
FIG. 2 shows the knitting steps according to the first embodiment of the present invention.
Figure 3:
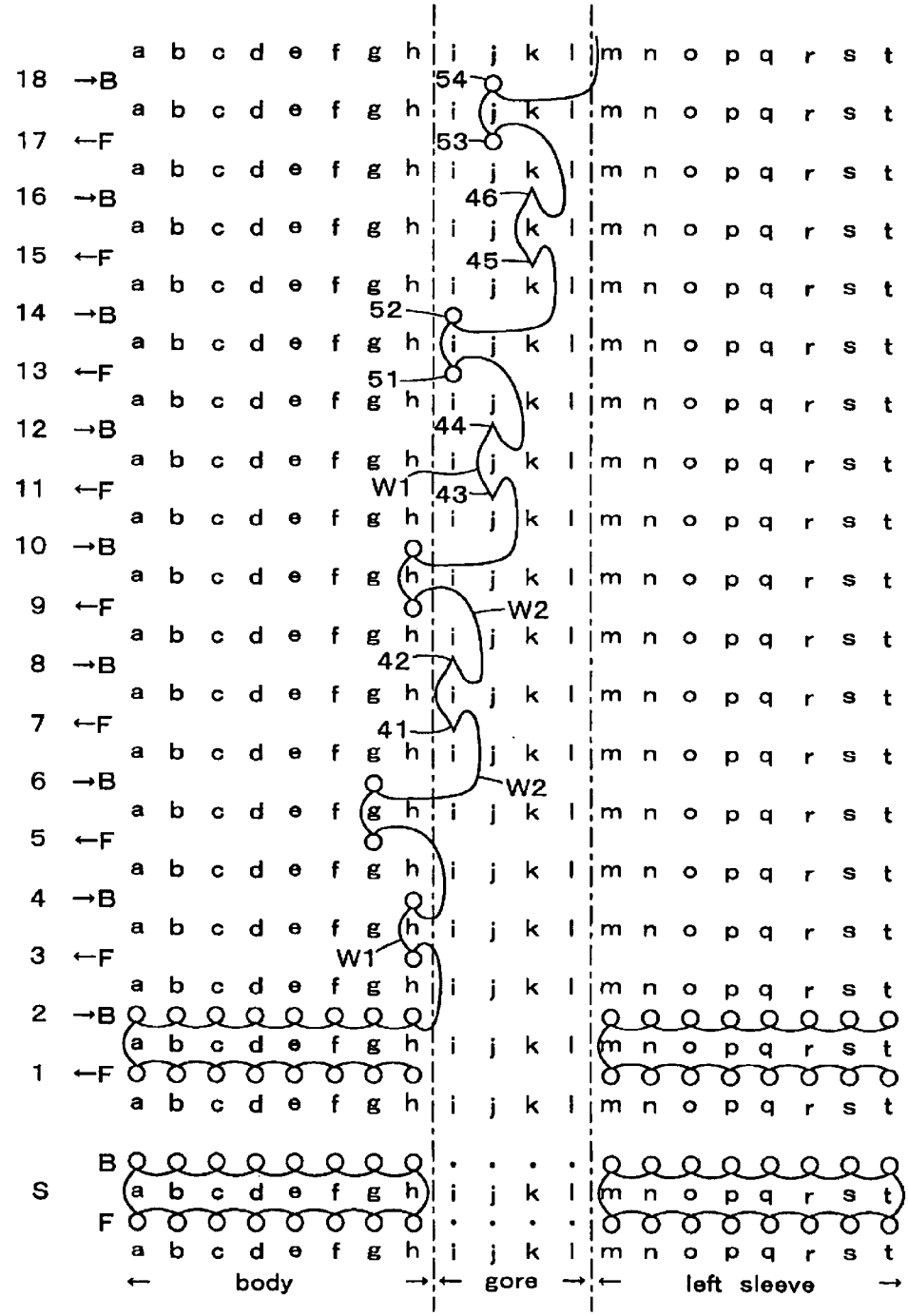
FIG. 3 shows the first half of the knitting steps according to the second embodiment for forming a gore at a joining portion.
Figure 4:
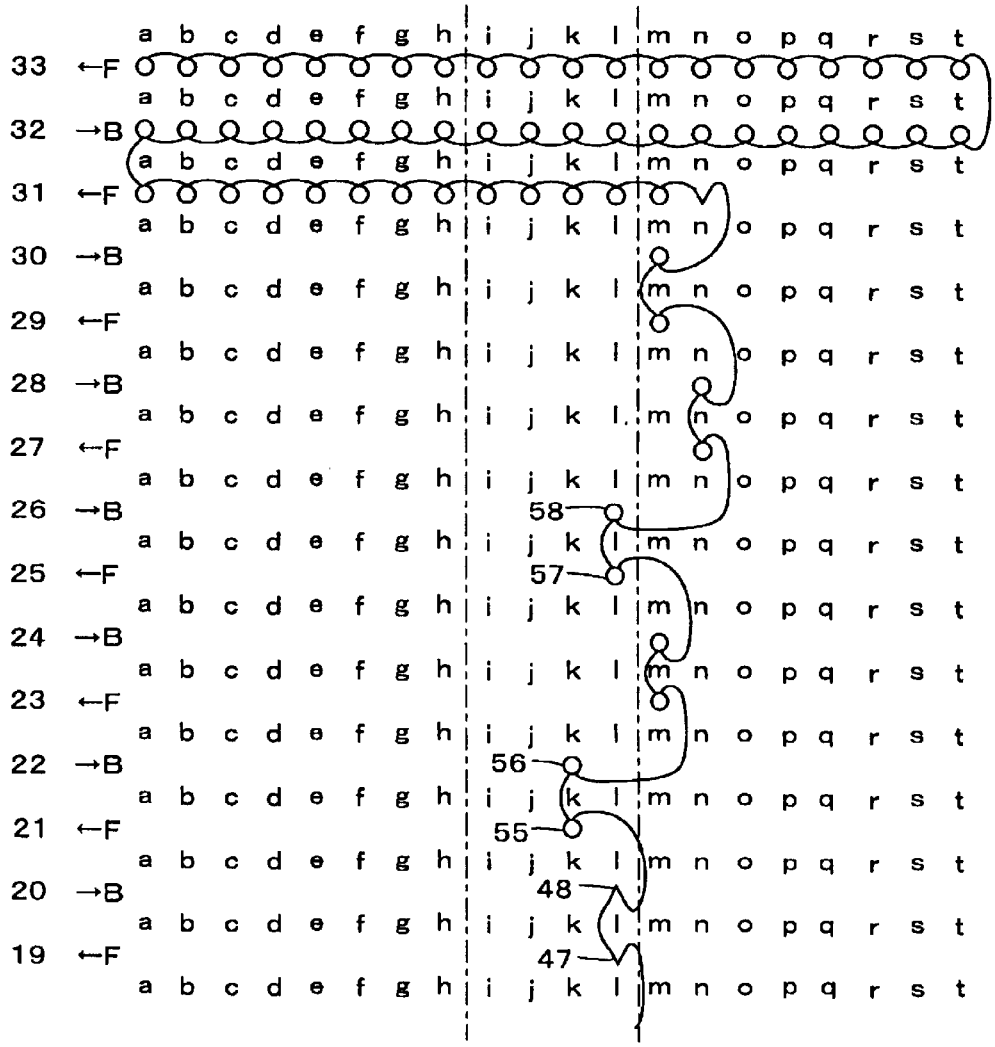
FIG. 4 shows the second half of the same.
Figure 5:
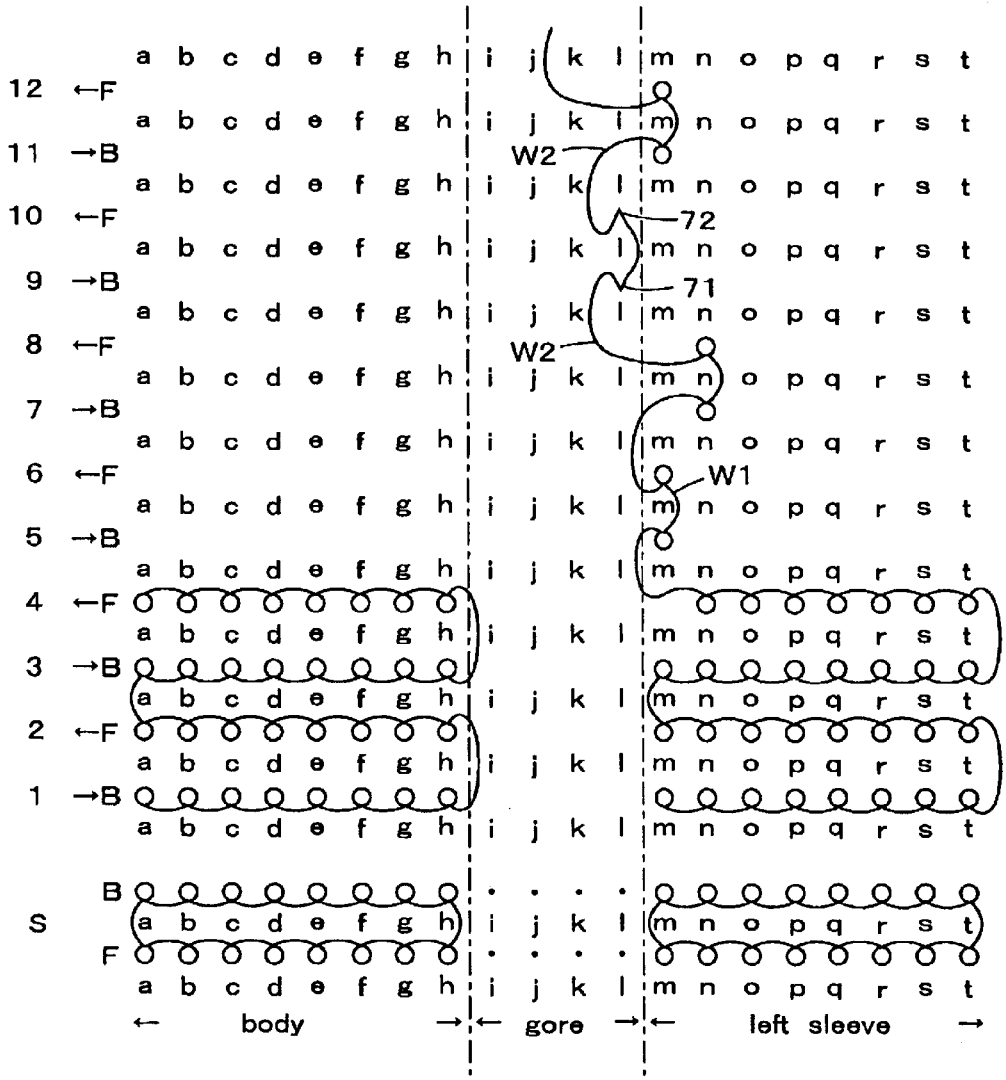
FIG. 5 shows the first half of the knitting steps according to a variant of the second embodiment.
Figure 6:
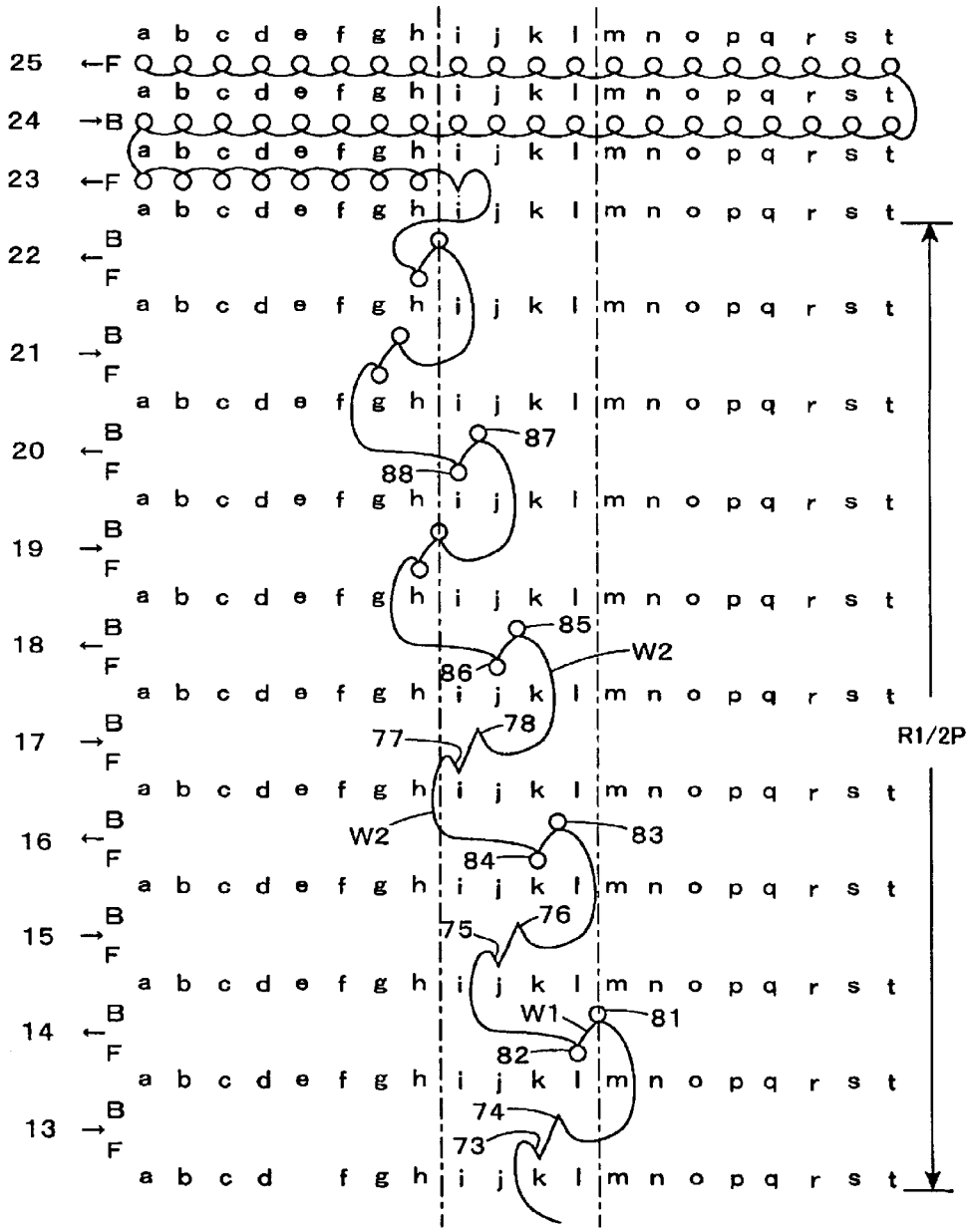
FIG. 6 shows the second half of the same.

Certain preferred embodiments of the present invention will be described with reference to the accompanying drawings. FIG. 1 shows a sweater 1 of knitwear immediately before the body 3 and one of the sleeves (only the left sleeve 5 is shown in the figure) are joined at a side part 7 of the sweater. The sweater 1 can be knitted by using, for example, a flat knitting machine of a general type, what is called a two-bed flat knitting machine, comprising a pair of front and back needle beds, either or both of which is/are capable of being racked. The body 3 and the sleeve 5 start knitting from the hem toward the shoulder with needles in different regions on the flat knitting machine so that they are each knitted in the form of a tubular knitted fabric in which their front fabrics 3*a*, 5*a* and back fabrics 3*b*, 5*b* are joined to each other at ends thereof on the side adjacent to each other. In this state, the front fabrics of the body 3 and sleeve 5 are held on the needles of the front needle bed and the back fabrics of the body 3 and sleeve 5 are held on the needles of the back needle bed. FIG. 2 shows the knitting steps according to the first embodiment for joining together the body 3 and the sleeve 5. FIGS. 3 and 4 show the knitting steps according to the second embodiment for forming a gore comprising an adequate number of wale at a side part of the sweater so as to form the joining portion. FIGS. 5 and 6 show a variant of the second embodiment. In the drawings, for convenience of explanation, an even fewer number of needles used for the knitting than the actual number of needles used for knitting a knitted fabric is illustrated. The numerals at the left side of the drawings indicate the serial number of knitting steps and the horizontal arrows at right side thereof indicate the stitch transfer direction. The alphabetical characters F and B indicate the front needle bed and the back needle bed, respectively; and the alphabetical characters a to t indicate the needles.

First Embodiment

In the first embodiment, there is shown an example that the body 3 and the sleeve 5 are joined together with two loops of the body 3 and the sleeve 5 formed at each end thereof on the sides adjacent to each other. The step S shows the state in which loops of the body 3 and the sleeve 5 are held on the needle beds when the knitting reaches the state of FIG. 1. The front body 3*a* is held on the needles a–h of the front needle bed and the back body 3*b* is held on the needles a–h of the back needle bed. The front knitted fabric 5*a* of the sleeve is held on the needles i–p of the front needle bed and the back knitted fabric 5*b* of the sleeve is held on the needles i–p of the back needle bed. The steps 1 and 2 show a course of loops of the body 3 and a course of loops of the sleeve 5 immediately before they are joined together at their side parts, the loops being knitted by using two different yarns, respectively. By repeating the knitting of the steps 1 and 2, the body 3 and the sleeve 5 are each knitted in a tubular form.

In the sequent steps 3–14, the body 3 and the sleeve 5 are joined together at ends thereof on the side adjacent to each other, to form the joining portion. In this embodiment, the joining portion is formed from the body 3 side to the sleeve 5 side, or from left to right, by using the yarn used to knit the body 3. First, in the step 3, a yarn feeder (not shown) is shifted leftward to feed the yarn the needle h of the front needle bed holding the loop of the front body 3*a* at the right side end, so as to form a knitted loop 11 thereon. In the next step 4, the yarn feeder is reversed in traveling direction to feed the yarn to the needle h of the back needle bed holding the loop of the back body 3*b* at the right side end, so as to form a knitted loop 13 thereon.

In the sequent steps 5 and 6, the yarn feeder is shifted backward one stitch with respect to a join processing direction, to feed the yarn to the needles g holding the loops of the body 3 formed one stitch inward of the end of the body 3, so that a knitted loop 15 is formed on the needle g on the front needle bed in the step 5 and a knitted loop 17 is formed on the needle g on the back needle bed in the step 6. In the steps 7 and 8, the yarn feeder is shifted forward two stitches with respect to the join processing direction, to feed the yarn to the needles i holding the loops of the left sleeve 5 at the left end thereof, so that a knitted loop 19 is formed on the needle i on the front needle bed in the step 7 and a knitted loop 19 is formed on the needle i on the back needle bed in the step 8. In the sequent steps 9 and 10, the yarn feeder is shifted backward one stitch with respect to the processing direction, to feed the yarn to the needles h holding the loops of the body 3 at the end thereof, so that a knitted loop 23 is formed on the needle h on the front needle bed in the step 9 and a knitted loop 25 is formed on the needle h on the back needle bed in the step 10.

Then, in the sequent steps 11 and 12, the yarn feeder is further shifted forward two stitches with respect to the join processing direction, to feed the yarn to the needles j holding the loops of the left sleeve 5 formed one stitch inward of the left end of the left sleeve 5, so that a knitted loop 27 is formed on the needle j on the front needle bed in the step 11 and a knitted loop 29 is formed on the needle j on the back needle bed in the step 12. In the sequent steps 13 and 14, the yarn feeder is shifted backward one stitch with respect to the processing direction, to feed the yarn to the needles i holding the loops of the left sleeve 5 formed at the end thereof, so that a knitted loop 31 is formed on the needle i on the front needle bed in the step 13 and a knitted loop 33 is formed on the needle i on the back needle bed in the step 14.

After the body 3 and the sleeve 5 are joined together at ends thereof on the side adjacent to each other as mentioned above, the needle j of the front needle bed tucks in the step 15 and knitted loops are formed on the needles i–a by feeding the yarn to those needles. The knitting shown in the sequent steps 16 and 17 is repeatedly performed to knit the body and the sleeve into a single tubular body from the side part thereof. Another sleeve is also joined to the body in the same manner, though the illustration is omitted.

As described above, the knitted loops in the joining portion of the body 3 and left sleeve 5 are formed in the tubular knitting in which the knitted loop formed with the needle of the back needle bed follows the knitted loop formed with the needle of the front needle bed, while the step of feeding the yarn to needles holding the loops formed one stitch backward and then to the needles holding the loops formed two stitches forward of the needles with respect to the join processing direction being repeatedly taken. Since the knitted loops of the body 3 at the end thereof on the side adjacent to the sleeve that follows the knitting of the final round of the body 3 are formed in the tubular knitting, the cross-over yarn W1 is extended straight between the knitted loops formed in the joining portion (e.g. between the knitted loops 11 and 13 and between the knitted loops 15 and 17) from back to front or from front to back along a back-and-forth direction. This can allow the knitted loops in the joining portion to be joined to each other closely so as to prevent the joining portion from being holed.

Further, since the tubular knitting is repeatedly performed with the needles holding the loops formed one stitch backward and the needles holding the loops formed two stitches forward with respect to the join processing direction, the cross-over yarn W2 is extended between the right and left knitted loops (e.g. between the knitted loops 17 and 19 and between the knitted loops 13 and 15). This can provide the result that even when the side part of the sweater is pulled in wearing, since the cross-over yarn W2 is drawn out from the knitted fabric, the joining portion can be well stretched. This can simultaneously provide an increased tensile strength of the side part of the sweater, leading to prevention of the knitted fabric from being torn at the side part thereof In addition, this can produce less protuberant joining portion, as compared with the conventional method of forming the joining portion by overlapping the stitch loops with each other.

Second Embodiment

FIGS. 3 and 4 show the knitting steps according to the second embodiment. There is shown an example that a gored joining portion comprising an adequate number of wale is formed in the side part 7. In the step S, the front body 3 is held on the needles a–h of the front and back needle beds and the sleeve 5 is held on the needles m–t of the front and back needle beds, respectively. Empty needles i, j, k, l are inserted in the space between the body 3 and the sleeve 5, to form a gore therebetween.

As is the case with the first embodiment, the knitting of the joining portion starts from the body 3 toward the sleeve 5 in this embodiment. In the knitting, the knitted loops are formed, with the step of feeding the yarn to the needles holding loops formed one stitch backward and then to the needles holding loops formed two stitches forward with respect to the processing direction being taken repeatedly. Except that the step of forming the gore is added when the joining portion is formed in the steps 3–30, the second embodiment is substantially the same as the first embodiment. To form the gore, the yarn is fed to the empty needles i, j, k, l and hooked by those needles (loops 41–48) in the steps 7, 8, 11, 12, 15, 16, 19, 20. The yarn is fed again to those needles i, j, k, l in the sequent steps 13, 14, 17, 18, 21, 22, 25, 26 to form the knitted loops 51–58 thereon. The joining portion thus formed is provided with an elasticized gore, so that it is prevented from being holed and also is increased in stretch and tensile strength.

Variant of Second Embodiment

FIGS. 5 and 6 show a variant of the second embodiment. This variant is the same as the second embodiment in that the gore is formed with the needles holding the body 3 and the left sleeve 5 and the needles i–l. In this variant, the knitting of the joining portion is performed starting from the left sleeve 5 to the body 3 by using the yarn used for the knitting of the left sleeve 5. The body 3 and the left sleeve 5 are each knitted in a tubular form by repeating the steps 1 and 2. The steps 3 and 4 show the knitting of a course of loops in the final round of the body 3 and that of the sleeve 5. In the step 3, the yarn is fed to the needles of the back needle bed and, in the sequent step 4, the yarn is fed to the needles of the front needle bed, with which the knitting of the final courses are ended. In this variant, the knitting of the course of loops in the final round is ended on the front needle bed and the joining process starts from the same front needle bed in the sequent step. Accordingly, in the course knitting of the left sleeve 5 in the step 4, the yarn is not fed to the needle m, so that the needle m misses the yarn.

The steps 5–12 correspond in knitting contents to the steps 3–10 of the second embodiment except the join processing direction. The knitting starts at the needle holding a loop of the wale of one tubular knitted fabric at an end thereof on the side adjacent to the other tubular knitted fabric. The steps 13–22 correspond to the steps 11–30 of the second embodiment. In the second embodiment, the knitted loops in the joining portion are formed in the tubular knitting in which after the knitted loop is formed by the needle of the front needle bed, the yarn feeder is reversed in traveling direction to feed the yarn to the needle opposite to the related needle of the back needle bed, so as to form the next knitted loop, while in this variant, the knitted loops in the joining portion are formed in the rib knitting instead of the tubular knitting. In the steps 13–22, the back needle bed is racked rightward relative to the front needle bed by one second of the needle pitch (R1/2P) only. In the steps 13, 15, 17, the yarn is fed to the empty needles k, j, i of the front and back needle beds and is hooked by those needles (loops 73–78). In the steps 16, 18, 20, the yarn is fed again to the needles by which the yarn was hooked in the steps 13, 15, 17, to form knitted loops 83–88 thereon.

In the step 13, the yarn feeder is shifted rightward to feed the yarn to the empty needles k, k of the front and back needle beds, so as to do the rib knitting (loops 73, 74). In the step 14, the yarn feeder is shifted backward one stitch with respect to the processing direction to feed the yarn to the needles l of the front and back needle beds, so as to form knitted loops 81, 82 thereon. In the next step 15, the yarn is fed rightward to the needles j located two stitches forward thereof, so as to do the rib knitting (loops 75, 76). In the step 16, the yarn feeder is shifted backward one stitch to feed the yarn to the needles k of the front and back needle beds, so as to form knitted loops 83, 84 thereon. This knitting is repeatedly provided for the remaining needles, with which the knitting process of the joining portion is ended. The steps after the step 23 correspond to the steps 15–17 of the first embodiment. With the needle i of the front needle bed tucking, knitted loops are formed on the needles h–a by feeding the yarn to those needles. The knitting shown in the sequent steps 24 and 25 is repeatedly performed to knit the body and the sleeve into a single tubular body from the side part thereof. The joining portion thus formed can provide the same effect as that of the second embodiment. Also, since the joining portion is at least gored in the rib knitting, rather than in the tubular knitting, the number of times the yarn feeder is reversed in the yarn feed direction can be reduced to provide an improved knitting efficiency.

A knitting program for a knitting machine is usually prepared by using a computer aided design system (CAD). In general, a knit pattern drawn on the CAD is changed in accordance with presence or absence of the gore formed in the joining portion. According to the method of the present invention, since the knitted loops in the joining portion are formed with the step of feeding the yarn to the needles holding loops formed one stitch backward and then to the needles holding loops formed two stitches forward with respect to the processing direction being taken repeatedly, the same knit pattern can be used, whether the gore is formed in the joining portion. This can provide the advantage of making it easy to control the knit pattern. W1 in the drawings indicates a cross-over yarn extending in a back-and-forth direction and W2 indicates a cross-over yarn extending in a right-and-left direction.

Although the examples using the two-bed flat knitting machine have been illustrated in the embodiments mentioned above, it is needless to say that modifications may be made in the present invention such as, for example, using a four-bed flat knitting machine in place of the two-bed flat knitting machine, or applying the method of the present invention to a crotch of leg-wear such as tights, rather than to the side part of the sweater, without departing from the spirit and scope of the present invention.

What is claimed is:

1. A method of joining together at least two tubular knitted fabrics by using a flat knitting machine comprising at least a pair of first and second needle beds, either or both of which is capable of being racked in a horizontal direction, wherein after front and back knitted fabric parts of the tubular knitted fabrics are joined to each other at widthwise ends thereof on the side adjacent to each other to form the at least two tubular knitted fabrics with needles in different regions on the flat knitting machine, the tubular knitted fabrics thus formed are joined to each other at ends thereof on the side adjacent to each other, to form a joining portion, such as a side part or a crotch of knitwear, and wherein the joining process commences from one of the tubular knitted fabrics toward the other tubular fabric in the state in which one of the front knitted fabric part and the back knitted fabric part of the at least two tubular knitted fabrics is held on the first needle bed and the other of the front knitted fabric part and the back knitted fabric part of the at least two tubular knitted fabrics is held on the second needle bed, to join together the both tubular knitted fabrics, the method comprising the following steps:

a) providing a tubular knitting, starting a joining process from a needle (h) holding a loop in a wale of one of the tubular knitted fabrics at an end thereof, that a yarn is fed to the needle (h) of one needle bed holding the loop in the wale of the one tubular knitted fabric at an end thereof in a direction opposite to a join processing direction, to form a knitted loop thereon, first, and, then, the yarn is fed to a needle (h) of the other needle bed in the join processing direction, to form a knitted loop thereon, b) providing the same tubular knitting as in the step a) for needles (g) holding loops formed one stitch backward of the needles (h) used in the step a) with respect to the join processing direction, c) shifting the yarn to the needles (i) holding loops in a wale of the other tubular knitted fabric at an end thereof on the side adjacent to the one tubular knitted fabric formed two stitches forward of the needles (g) used in the step b) with respect to the join processing direction, to provide the same tubular knitting as in the step above for the needles (i), d) feeding the yarn to the needles (h) holding the loops of the other tubular knitted fabric formed one stitch backward of the needles (i) used in the step c) with respect to the join processing direction, to provide the same tubular knitting as in the step above for the needles (h), e) shifting the yarn to the needles (j) holding loops formed two stitches forward of the needles (h) used in the step d) with respect to the join processing direction, to provide the same tubular knitting as in the step above for the needles (j), and f) feeding the yarn to the needles (i) holding the loops formed one stitch backward of the needles (j) used in the step e) with respect to the join processing direction, to provide the same tubular knitting as in the step above for the needles (i).

2. The method of joining together the tubular knitted fabrics according to claim 1, wherein the joining portion is provided by using the yarn used in knitting the one tubular knitted fabric.

3. The method of joining together the tubular knitted fabrics according to claim 1, wherein an adequate number of empty needles are inserted in between the adjacent tubular knitted fabrics and wherein the steps of feeding the yarn to the needles holding loops formed one stitch backward and then to the needles holding loops formed two stitches forward with respect to the join processing direction are repeatedly provided for the empty needles as well to form the knitted loops thereon, so as to form a gore in the joining portion.

4. The method of joining together the tubular knitted fabrics according to claim 3, wherein the knitted loops in the gore are formed in the rib knitting.

5. A knitted fabric produced in the method according to claim 1.

6. A knitted fabric produced in the method according to claim 2.

7. A knitted fabric produced in the method according to claim 3.

8. A knitted fabric produced in the method according to claim 4.

* * * * *